US009784445B2

(12) United States Patent
Cao et al.

(10) Patent No.: US 9,784,445 B2
(45) Date of Patent: Oct. 10, 2017

(54) EXTERNAL BED TYPE DOUBLE-FLUIDIZED BED SYSTEM FOR PREVENTING BOILER CONTAMINATION

(71) Applicant: Dongfang Electric Corporation, Chengdu, Sichuan (CN)

(72) Inventors: Liyong Cao, Chengdu (CN); Wei Fan, Chengdu (CN); Qi Du, Chengdu (CN); Pan Guo, Chengdu (CN); Zhengning Liu, Chengdu (CN); Jiang Liu, Chengdu (CN); Yuan Zhang, Chengdu (CN); Chunfei Zhang, Chengdu (CN); Hongwei Hu, Chengdu (CN); Yang Li, Chengdu (CN); Xin Zhang, Chengdu (CN)

(73) Assignee: Dongfang Electric Corporation, Chengdu (CN)

( * ) Notice: Subject to any disclaimer, the term of this patent is extended or adjusted under 35 U.S.C. 154(b) by 199 days.

(21) Appl. No.: 14/646,457

(22) PCT Filed: Oct. 9, 2013

(86) PCT No.: PCT/CN2013/084879
§ 371 (c)(1),
(2) Date: May 21, 2015

(87) PCT Pub. No.: WO2014/079283
PCT Pub. Date: May 30, 2014

(65) Prior Publication Data

US 2015/0292735 A1 Oct. 15, 2015

(30) Foreign Application Priority Data

Nov. 21, 2012 (CN) ..... 2012 1 0473056

(51) Int. Cl.
*F23C 10/10* (2006.01)
*F23C 10/00* (2006.01)
(Continued)

(52) U.S. Cl.
CPC ..... *F23C 10/10* (2013.01); *F23C 6/02* (2013.01); *F23C 10/005* (2013.01); *F23C 10/22* (2013.01);
(Continued)

(58) Field of Classification Search
CPC ..... F23C 10/005
(Continued)

(56) References Cited

U.S. PATENT DOCUMENTS 4,430,854 A * 2/1984 Adrian ..... F01K 23/062 60/39.181
5,237,963 A * 8/1993 Garcia-Mallol .... F22B 31/0084 110/210
(Continued)

FOREIGN PATENT DOCUMENTS

CN 2376579 Y 5/2000
CN 1427201 A 7/2003
(Continued)

*Primary Examiner* — Avinash Savani
(74) *Attorney, Agent, or Firm* — Porter, Wright, Morris & Arthur LLP

(57) ABSTRACT

An external bed type double-fluidized bed system for preventing boiler contamination includes a fluidized bed combustion furnace, a cyclone separator, a coal ash distributor and a fluidized bed pyrolysis furnace. The fluidized bed combustion furnace is connected with the coal ash distributor, the coal ash distributor is connected with the coal ash inlet on a side wall of the fluidized bed combustion furnace through a return feeder with which the coal ash outlet of the fluidized bed pyrolysis furnace is also connected through an external bed, and the return feeder is connected with the
(Continued)

fluidized bed combustion furnace. A fuel coal is pyrolyzed in the fluidized bed pyrolysis furnace at a temperature to volatize alkali chlorides into a pyrolysis gas, thereby reducing the content of the alkali chlorides contained in the coal in the fluidized bed combustion furnace and relieving the contamination to a convective heat-absorbing surface.

17 Claims, 1 Drawing Sheet

(51) Int. Cl.

| | |
|---|---|
| ***F23C 10/22*** | (2006.01) |
| ***F23C 10/26*** | (2006.01) |
| ***F23J 1/02*** | (2006.01) |
| ***F23J 15/02*** | (2006.01) |
| ***F23C 6/02*** | (2006.01) |

(52) U.S. Cl.
CPC ..... *F23C 10/26* (2013.01); *F23J 1/02* (2013.01); *F23J 15/02* (2013.01); *F23C 2900/10005* (2013.01)

(58) Field of Classification Search
USPC ..... 431/170; 110/203, 165 R
See application file for complete search history.

(56) References Cited

U.S. PATENT DOCUMENTS

| | | | | |
|---|---|---|---|---|
| 7,981,835 | B2 * | 7/2011 | Srinivasachar ..... | B01J 20/20 423/460 |
| 2010/0011610 | A1 * | 1/2010 | Bittorf ..... | F26B 3/08 34/359 |

FOREIGN PATENT DOCUMENTS

| | | | |
|---|---|---|---|
| CN | 1727750 | A | 2/2006 |
| CN | 1318796 | C | 5/2007 |
| CN | 102174331 | A | 9/2011 |
| CN | 102937290 | A | 2/2013 |
| CN | 202993181 | U | 6/2013 |
| EP | 2273192 | A1 | 1/2011 |
| JP | 2005041959 | A | 2/2005 |
| WO | WO 2005124232 | A1 | 12/2005 |

* cited by examiner

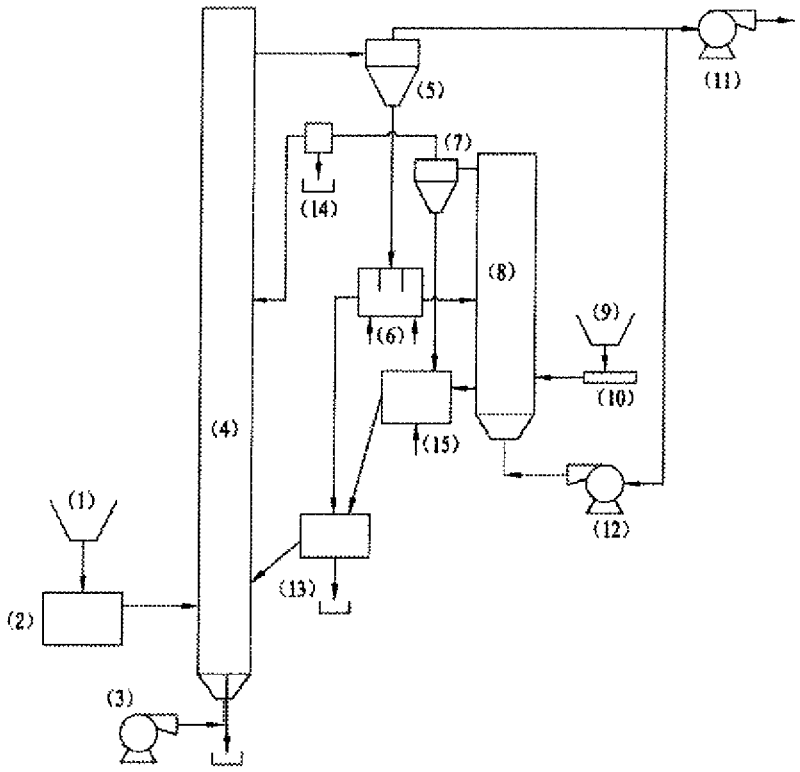
(1)
(2)
(3)
(4)
(5)
(6)
(7)
(8)
(9)
(10)
(11)
(12)
(13)
(14)
(15)

EXTERNAL BED TYPE DOUBLE-FLUIDIZED BED SYSTEM FOR PREVENTING BOILER CONTAMINATION

TECHNICAL FIELD OF THE INVENTION

The disclosure relates to a technology for preventing the contamination to a double-fluidized bed's boiler and more particularly to an external bed type double-fluidized bed system for preventing boiler contamination.

BACKGROUND OF THE INVENTION

Thermal power generation plays a major role in our country power generation industry, the installed capacity of the thermal power has been higher than 70%. Although advantaged in low cost to control pollution, high fuel applicability, wide load regulation range and so on, circulating fluidized bed combustion technology causes corrosion to a device such as a boiler heating surface and fouling and slagging when burning a high-alkalinity coal as the alkali compounds in the coal, after volatilizing during the combustion process, are likely to condense on a boiler heating surface to form a sintered or adhered ash deposit. Fouling and slagging will reduce the heat transfer efficiency of a boiler, lower the output of the boiler and severely impair the operation safety of a device.

To avoid the various problems caused by fouling and slagging, a lot of research has been made on the mechanism of fouling and slagging by scholars at home and abroad, the result shows that fouling and slagging is a complicated physical and chemical reaction process and that the slagging in a boiler is both a complicated physical and chemical process and a dynamic process and is related to both fuel characteristics and the structure and the running conditions of the boiler. A plurality of slagging determination indexes have been proposed by the scholars which confront many limitations in the actual application and therefore only serve for a preliminary determination but cannot fundamentally eliminate the damages caused by contamination to a boiler. During the running process of a power plant, the combustion of pulverized coal generates high-temperature smoke and ash, for a high-alkalinity coal, the alkali metals contained in the high-alkalinity coal volatilize in a gas at a high temperature, the gas flows to a subsequent convective heat exchange surface with the high-temperature smoke, and after the gas contacts with the convective heat exchange surface relatively low in temperature, the alkali metals deposit on the surface of a convective heat exchanger and with a relatively high viscosity, absorb fly ash to generate contamination to the heat-absorbing surface. For a high-alkalinity coal, research shows that due to the volatilization of the alkali metal elements in the high-alkalinity coal, the adhesive deposit basically formed by alkali metal salts, calcium sulfate or the eutectic of sodium, potassium, calcium and sulfates exists mainly in the form NaCl or $Na_2SO_4$. The continuous absorption of the deposit to fly ash causes varying degrees of contamination to the convective heat-absorbing surface, moreover, the contaminants which cannot be removed using a soot blower reduce the heat transfer capability of the heat-absorbing surface, increase the temperature of the smoke discharged from the boiler and finally greatly reduce the output of the furnace of the boiler to shut down the boiler.

Thus, if the proportion of the alkali metal compounds in the smoke can be reduced, then the contamination to the convective heat-absorbing surface of the boiler can be fundamentally solved or relieved.

At present, there is a domestic lack of the engineering operation experience on the use of the combustion of a high-alkalinity coal, only several power plants in Xinjiang are studying the problem of the contamination caused by the combustion of a high-alkalinity coal but have not developed any effective high-alkalinity coal utilization method. Although a method is available by means of which the slagging of a boiler is relieved by controlling the temperature and the combustion in a furnace through the optimization of the combustion mode of the boiler, the method, which cannot be operated conveniently in the actual application, is not popularized. As to a method of relieving the contamination to a boiler through non-local coal blended combustion, the proportion of the high-alkalinity coal blended for combustion should be below 30% when Zhun-Dong coal is blended with other coals for combustion. When the proportion of the high-alkalinity coal blended for combustion is increased, the contamination caused by an ash deposit to the convective heat-absorbing surface of a boiler is severe; meanwhile, alkali metals cause serious corrosion to the material of the body of the boiler, thus making it difficult to design and operate a circulating fluidized bed's boiler. As high-alkalinity coals are mainly used by electric power stations near coal-mines in Xinjiang, a high amount of non-local coals is needed for blended combustion, which not only greatly limits the amount of the used ZhunDong coal but also requires the purchasing of high-quality fire coals from other places, as a result, the power generation cost of power generation enterprises is increased. Consequently, it is difficult to exploit ZhunDong coal fields and construct power source bases, and the exploitation of the advantages of Zhundong coal to the full is hindered. For this reason, it is urgently needed to solve the problem of the contamination caused to a convective heat-absorbing surface when a boiler merely burns high-alkalinity coals.

SUMMARY OF THE INVENTION

To address the foregoing problem of the contamination to a convective heat-absorbing surface caused when existing pulverized coal fired boiler and circulating fluidized bed's boiler burn high-alkalinity coals, the disclosure provides an external bed type double-fluidized bed system for preventing boiler contamination to reduce the difficulty of arranging a boiler heating surface, increase a heat exchange area, guarantee the full heat exchange of the boiler heating surface, stabilize a boiler output and prevent the temperature of a convective heat-absorbing surface from being overhigh for contamination to greatly reduce the probability of the occurrence of a pipe bursting accident.

To address the technical problem above, the technical solution of the disclosure is as follows:

an external bed type double-fluidized bed system for preventing boiler contamination comprises: a fluidized bed combustion furnace, a cyclone separator, a coal ash distributor and a fluidized bed pyrolysis furnace, wherein the fluidized bed combustion furnace is connected with a first feeder, the outlet on the upper end of a side wall of the fluidized bed combustion furnace is connected with the inlet of the cyclone separator, the cyclone separator separates the high-temperature coal ash from the fluidized bed combustion furnace, the outlet on the bottom of the cyclone separator is connected with the inlet of the coal ash distributor to feed the separated high-temperature coal ash into the coal ash distributor, a smoke outlet is provided on the top of the cyclone separator; a first coal ash outlet and a second coal ash outlet are provided on the coal ash distributor, the first coal ash outlet is connected with the coal ash inlet on a side wall of the fluidized bed combustion furnace through a return feeder, and the second coal ash outlet is connected with the coal ash inlet on a side wall of the fluidized bed pyrolysis furnace; a pyrolysis gas outlet is provided on the upper end of a side wall of the fluidized bed pyrolysis furnace, a raw coal inlet is provided in the middle or on the lower part of a side wall of the fluidized bed pyrolysis furnace; a coke-coal ash mixture outlet provided on the lower end of a side wall of the fluidized bed pyrolysis furnace, the coke-coal ash mixture outlet is connected with the return feeder through an external bed and then connected with the coal ash inlet of the fluidized bed combustion furnace through the return feeder.

The system is further equipped with a cleaner and a pyrolysis separator, a pyrolysis gas inlet is provided on the side wall of the pyrolysis separator, a pyrolysis gas outlet is provided on the top of the pyrolysis separator, and a pyrolyzed coal ash outlet is provided on the bottom of the pyrolysis separator for separating the obtained pyrolyzed coal ash; the pyrolysis gas inlet of the pyrolysis separator is connected with the pyrolysis gas outlet on the fluidized bed pyrolysis furnace, the pyrolysis gas outlet of the pyrolysis separator is connected with the inlet of the cleaner, the pyrolyzed coal ash outlet of the pyrolysis separator is connected with the external bed through which the pyrolyzed coal ash outlet of the pyrolysis separator is connected with the return feeder, and the return feeder is connected with the fluidized bed combustion furnace.

The smoke outlet on the top of the cyclone separator is connected with the bottom of the fluidized bed pyrolysis furnace through a blower so as to feed the separated high-temperature smoke into the fluidized bed pyrolysis furnace.

Further, the smoke outlet of the cyclone separator is connected with a chimney through a draught fan.

That is, one part of the smoke from the top of the cyclone separator is fed into the fluidized bed pyrolysis furnace through a blower while the other part is discharged from a chimney through a draught fan.

Further, the coal ash outlet of the fluidized bed pyrolysis furnace is connected with the external bed, the external bed is connected with the coal ash inlet on a side wall of the fluidized bed combustion furnace through the same return feeder.

The fluidized bed combustion furnace is connected with the first feeder which is provided with a first coal hopper.

The outlet of the cleaner is connected with the pyrolysis gas inlet on a side wall of the fluidized bed combustion furnace.

The raw coal inlet of the fluidized bed pyrolysis furnace is connected with a second feeder which is provided with a second coal hopper.

The working process of the system is as follows:

the pyrolyzed semi-coke is combusted with the air in the chamber of the fluidized bed combustion furnace, the resulting coal ash and smoke enters the cyclone separator to be separated, one part of the separated smoke is fed into the fluidized bed pyrolysis furnace through the blower while the other part is discharged from the chimney through the draught fan; the separated coal ash enters the coal ash distributor to be divided into two parts according to the need of the fluidized bed pyrolysis furnace: one part is directly returned to the chamber of the fluidized bed combustion furnace by the return feeder through the first coal ash outlet while the other part enters the fluidized bed pyrolysis furnace through the second coal ash outlet to be mixed with the high-alkalinity coals from the second coal hopper and the second feeder and then pyrolyzed in the fluidized bed pyrolysis furnace, the sodium contained in the gas resulting from the pyrolysis is removed using the cleaner, then the gas enters the fluidized bed combustion furnace to be combusted therein; the pyrolyzed hot ash and high-alkalinity semi-coke enters the external bed to be exchanged heat, after the temperature of the hot ash and the high-alkalinity semi-coke is adjusted, the hot ash and the high-alkalinity semi-coke enter the return feeder through the external bed and is then fed into the fluidized bed combustion furnace by smoke to be combusted herein; the slag discharging of the boiler is carried out on the bottom of the fluidized bed combustion furnace; most of volatilizable sodium is removed after the high-alkalinity coals are pyrolyzed in the fluidized bed pyrolysis furnace, as the sodium content of the high-alkalinity coals is reduced, the content of the active sodium in the smoke resulting from the combustion carried out in the chamber of the fluidized bed combustion furnace is greatly reduced, consequentially, there is almost no contamination caused when the smoke passes the subsequent heat-absorbing surface.

By using a two-bed system to first pyrolyze fire coal in a fluidized bed pyrolysis furnace at a high temperature to volatilize volatilizable alkali chlorides into pyrolysis gas, the disclosure reduces the content of the alkali metals contained in the coal entering a fluidized bed combustion furnace and therefore decreases the alkali metals in combustion-produced smoke, in this way, the disclosure fundamentally eliminates or greatly relieves the contamination to a convective heat-absorbing surface, besides, as the pyrolysis gas is fed into the fluidized bed combustion furnace to be combusted after the sodium in the pyrolysis gas is removed using a cleaner, the combustible components contained in the coal is effectively used, thus guaranteeing the combustion efficiency of a boiler. The heat exchange between the heat-absorbing surface of an external bed with pyrolyzed semi-coke and pulverized coal ash not only increases a heat exchange capacity but also adjusts the temperature of a pyrolysis and combustion fluidized bed, thus keeping the system in an optimal working state.

The technical route of the disclosure is that combusted coal ash having a relatively high temperature is continuously separated and collected using the cyclone separator and then fed into the fluidized bed pyrolysis furnace through the coal ash distributor to be uniformly mixed with the pulverized coal fed by the second feeder, the pulverized coal entering the furnace is pyrolyzed in the fluidized bed pyrolysis furnace by means of the heat of the coal ash and the gas resulting from the combustion in the fluidized bed combustion furnace so that the alkali metals contained in the pulverized coal volatilizes into the pyrolysis gas at a high temperature, the pyrolysis gas enters a cleaner from the outlet of the pyrolysis separator provided on the top of the fluidized bed pyrolysis furnace, after the alkali metals contained in the pyrolysis gas are removed, the pyrolysis gas is fed into the chamber of the fluidized bed combustion furnace to be combusted. After being adjusted in temperature by the external bed, the mixture of the coke and coal ash from the outlet of the fluidized bed pyrolysis furnace enters the return feeder through the external bed, and the return feeder feeds the mixture into the chamber of the fluidized bed combustion furnace so that the mixture is combusted in the chamber of the fluidized bed combustion furnace. As the alkali metals in the coke are greatly decreased, the formation of an initial contamination layer for the adhesion of the alkali metal compounds contained in the smoke resulting from the combustion in the fluidized bed combustion furnace on the pipe wall of a convective heat-absorbing surface at a low temperature is prevented, thus breaking the initial condition for the formation of contamination.

The disclosure has the following beneficial effects:

(1) by removing the volatilizable Na contained in coal through the pyrolysis of the mixture of the boiler hot ash and high-alkalinity coals in a fluidized bed pyrolysis furnace, the disclosure lowers the content of the Na element contained in the coal of a combustion in the fluidized bed, reduces the contamination to the convective heat-absorbing surface of a boiler, improves the heat exchange efficiency of a heat exchange surface, stabilizes the output of the boiler;

(2) by pyrolyzing high-alkalinity metal coals using the circulating hot ash of a boiler and feeding the pyrolysis gas into the chamber of the boiler to combust the pyrolysis gas after cleaning the pyrolysis gas, the disclosure improves the efficiency of energy utilization, solves a problem of gas-solid separation for dust removal and saves the high cost caused by the current utilization of high-alkalinity coals merely through blended combustion;

(3) by arranging a heat-absorbing surface in an external heat exchanger to increase a heat exchange area, the disclosure lowers the difficulty of arranging a heat-absorbing surface in a boiler, reduces the contamination to the heat-absorbing surface of the boiler and improves the flexibility of load adjustment of the boiler, the gas temperature adjustment performance, the applicability and the heat conductivity performance of fuel;

(4) the disclosure realizes the large-scale pure combustion utilization of high-alkalinity coals without making a big modification on the design of existing boilers or causing an influence on the combustion efficiency of existing boilers, thus increasing the profit of power plants.

BRIEF DESCRIPTION OF DRAWINGS

FIG. 1 is a schematic diagram illustrating the structure of a system according to the disclosure.

Explanation of reference signs in FIG. 1: 1 first coal hopper; 2 first feeder; 3 first blower; 4 fluidized bed combustion furnace; 5: cyclone separator; 6 coal ash distributor; 7 pyrolysis separator; 8 fluidized bed pyrolysis furnace; 9 second coal hopper; 10 second feeder; 11 draught fan; 12 second blower; 13 return feeder; 14 cleaner; 15 external bed.

DETAILED DESCRIPTION OF THE EMBODIMENTS

The disclosure is described below in detail with reference to accompanying drawings.

As shown in FIG. 1, an external bed type double-fluidized bed system for preventing boiler contamination comprises: a fluidized bed combustion furnace 4, a cyclone separator 5, a coal ash distributor 6 and a fluidized bed pyrolysis furnace 8, wherein the fluidized bed combustion furnace 4 is connected with a first feeder 2, the outlet on the upper end of a side wall of the fluidized bed combustion furnace 4 is connected with the inlet of the cyclone separator 5, the cyclone separator 5 separates the high-temperature coal ash from the fluidized bed combustion furnace 4, the outlet on the bottom of the cyclone separator 5 is connected with the inlet of the coal ash distributor 6 to feed the separated high-temperature coal ash into the coal ash distributor 6, a smoke outlet is provided on the top of the cyclone separator 5; a first coal ash outlet and a second coal ash outlet are provided on the coal ash distributor 6, the first coal ash outlet is connected with the coal ash inlet on a side wall of the fluidized bed combustion furnace 4 through a return feeder 13, and the second coal ash outlet is connected with the coal ash inlet on a side wall of the fluidized bed pyrolysis furnace 8; a pyrolysis gas outlet is provided on the upper end of a side wall of the fluidized bed pyrolysis furnace 8, a raw coal inlet is provided in the middle or on the lower part of a side wall of the fluidized bed pyrolysis furnace 8; a coke-coal ash mixture outlet is provided on the lower end of a side wall of the fluidized bed pyrolysis furnace 8 and connected with the return feeder 13 through an external bed 15 and then connected with the coal ash inlet on the fluidized bed combustion furnace 4 through the return feeder 13.

The system is further equipped with a cleaner 14 and a pyrolysis separator 7, a pyrolysis gas inlet is provided on the side wall of the pyrolysis separator 7, a pyrolysis gas outlet is provided on the top of the pyrolysis separator 7, and a pyrolyzed coal ash outlet is provided on the bottom of the pyrolysis separator 7 for separating the obtained pyrolyzed coal ash. The pyrolysis gas inlet of the pyrolysis separator 7 is connected with the pyrolysis gas outlet on the fluidized bed pyrolysis furnace 8, the pyrolysis gas outlet of the pyrolysis separator 7 is connected with the inlet of the cleaner 14, the pyrolyzed coal ash outlet of the pyrolysis separator 7 is connected with an external bed 15 and further connected with the return feeder 13 through the external bed 15, and the return feeder 13 is connected with the fluidized bed combustion furnace 4.

The smoke outlet on the top of the cyclone separator 5 is connected with the bottom of the fluidized bed pyrolysis furnace 8 through a second blower 12 to feed the separated high-temperature smoke into the fluidized bed pyrolysis furnace 8.

Further, the smoke outlet of the cyclone separator 5 is connected with a chimney through a draught fan 11.

That is, one part of the smoke from the top of the cyclone separator 5 is fed into the fluidized bed pyrolysis furnace 8 through the second blower 12 while the other part is discharged from a chimney through the draught fan 11.

Further, the coal ash outlet of the fluidized bed pyrolysis furnace 8 is connected with the external bed 15, the external bed 15 is connected with the coal ash inlet on a side wall of the fluidized bed combustion furnace 4 through the same return feeder 13.

The first feeder 2 is provided with a first coal hopper 1.

The outlet of the cleaner 14 is connected with the pyrolysis gas inlet on a side wall of the fluidized bed combustion furnace 4.

The raw coal inlet of the fluidized bed pyrolysis furnace 8 is connected with a second feeder 10 which is provided with a second coal hopper 9.

The working process of the system is as follows:

pyrolyzed semi-coke is combusted with the air from the first blower 3 in the chamber of the fluidized bed combustion furnace 4, the resulting coal ash and smoke enters the cyclone separator 5 to be separated, one part of the separated smoke is fed into the fluidized bed pyrolysis furnace 8 through the second blower 12 while the other part is discharged from the chimney through the draught fan 11; the separated coal ash enters the coal ash distributor 6 to be divided into two parts according to the need of the fluidized bed pyrolysis furnace 8: one part is directly returned to the chamber of the fluidized bed combustion furnace 4 by the return feeder 13 through the first coal ash outlet while the other part enters the fluidized bed pyrolysis furnace 8 through the second coal ash outlet to be mixed with the high-alkalinity coals from the second coal hopper 9 and the second feeder 10 and then pyrolyzed in the fluidized bed pyrolysis furnace 8, the sodium contained in the gas resulting from the pyrolysis is removed using the cleaner 14, then the gas enters the fluidized bed combustion furnace 4 to be combusted; the pyrolyzed hot ash and high-alkalinity semi-coke enters the external bed 15 to be exchanged heat, after the temperature of the hot ash and the high-alkalinity semi-coke is adjusted, the hot ash and the high-alkalinity semi-coke enter the return feeder 13 through the external bed 15 and is then fed into the fluidized bed combustion furnace 4 by smoke to be combusted herein; the slag discharging of the boiler is carried out on the bottom of the fluidized bed combustion furnace 4; most of volatilizable sodium is removed after the high-alkalinity coals are pyrolyzed in the fluidized bed pyrolysis furnace 8, as the sodium content of the high-alkalinity coals is reduced, the content of the active sodium in the smoke resulting from the combustion carried out in the chamber of the fluidized bed combustion furnace 4 is greatly reduced, consequentially, there is almost no contamination caused when the smoke passes the subsequent heat-absorbing surface.

By using a two-bed system to first pyrolyze fire coal in the fluidized bed pyrolysis furnace 8 at a high temperature to volatilize volatilizable alkali chlorides into pyrolysis gas, the disclosure reduces the content of the alkali metals contained in the coal entering the fluidized bed combustion furnace 4 and therefore decreases the alkali metals in combustion-produced smoke, in this way, the disclosure fundamentally eliminates or greatly relieves the contamination to a convective heat-absorbing surface, besides, as the pyrolysis gas is fed into the fluidized bed combustion furnace 4 to be combusted after the sodium in the pyrolysis gas is removed using the cleaner 14, the combustible components contained in the coal is effectively used, thus guaranteeing the combustion efficiency of a boiler. The heat exchange between the heat-absorbing surface of the external bed 15 with pyrolyzed semi-coke and pulverized coal ash not only increases a heat exchange capacity but also adjusts the temperature of a pyrolysis and combustion fluidized bed, thus keeping the system in an optimal working state.

The technical route of the disclosure is that combusted coal ash having a relatively high temperature is continuously separated and collected using the cyclone separator 5 and then fed into the fluidized bed pyrolysis furnace 8 through the coal ash distributor 6 to be uniformly mixed with the pulverized coal fed by the second feeder 10, the pulverized coal entering the furnace is pyrolyzed in the fluidized bed pyrolysis furnace 8 by means of the heat of the coal ash and the gas resulting from the combustion in a fluidized bed combustion furnace 4 so that the alkali metals contained in the pulverized coal volatilizes into the pyrolysis gas at a high temperature, the pyrolysis gas enters a cleaner 14 from the outlet of the pyrolysis separator 7 provided on the top of the fluidized bed pyrolysis furnace 8, after the alkali metals contained in the pyrolysis gas are removed, the pyrolysis gas is fed into the chamber of the fluidized bed combustion furnace 4 to be combusted. After being adjusted in temperature by an external bed 15, the mixture of the coke and coal ash from the outlet of the fluidized bed pyrolysis furnace 8 enters a return feeder 13 through the external bed 15, and the return feeder 13 feeds the mixture into the chamber of the fluidized bed combustion furnace 4 so that the mixture is combusted in the chamber of the fluidized bed combustion furnace 4. As the alkali metals in the coke are greatly decreased, the formation of an initial contamination layer for the adhesion of the alkali metal compounds contained in the smoke resulting from the combustion in the fluidized bed combustion furnace 4 on the pipe wall of a convective heat-absorbing surface at a low temperature is prevented, thus breaking the initial condition for the formation of contamination.

What is claimed is:

1. An external bed type double-fluidized bed system for preventing boiler contamination, comprising a fluidized bed combustion furnace (4), a cyclone separator (5), a coal ash distributor (6) and a fluidized bed pyrolysis furnace (8), wherein an outlet on an upper end of a side wall of the fluidized bed combustion furnace (4) is connected with an inlet of the cyclone separator (5), the cyclone separator (5) separates a high-temperature coal ash from the fluidized bed combustion furnace (4), an outlet on a bottom of the cyclone separator (5) is connected with an inlet of the coal ash distributor (6) to feed the separated high-temperature coal ash into the coal ash distributor (6), a smoke outlet is provided on a top of the cyclone separator (5), a first coal ash outlet and a second coal ash outlet are provided on the coal ash distributor (6), the first coal ash outlet is connected with a coal ash inlet on a side wall of the fluidized bed combustion furnace (4) through a return feeder (13), the second coal ash outlet is connected with a coal ash inlet on a side wall of the fluidized bed pyrolysis furnace (8), a pyrolysis gas outlet is provided on an upper end of a side wall of the fluidized bed pyrolysis furnace (8), a raw coal inlet is provided in a middle or on a lower part of a side wall of the fluidized bed pyrolysis furnace (8), a coke-coal ash mixture outlet is provided on a lower end of a side wall of the fluidized bed pyrolysis furnace (8), the coke-coal ash mixture outlet is connected with the return feeder (13) through an external bed (15) and further connected with the coal ash inlet of the fluidized bed combustion furnace (4) through the return feeder (13), and the smoke outlet on the top of the cyclone separator (5) is connected with a bottom of the fluidized bed pyrolysis furnace (8) through a second blower (12) to feed separated high-temperature smoke into the fluidized bed pyrolysis furnace (8).

2. The external bed type double-fluidized bed system for preventing boiler contamination according to claim 1, further comprising a cleaner (14) and a pyrolysis separator (7), a pyrolysis gas inlet is provided on a side wall of the pyrolysis separator (7), a pyrolysis gas outlet is provided on a top of the pyrolysis separator (7), and a pyrolyzed coal ash outlet is provided on a bottom of the pyrolysis separator (7) for separating the obtained pyrolyzed coal ash; the pyrolysis gas inlet of the pyrolysis separator (7) is connected with the pyrolysis gas outlet on the fluidized bed pyrolysis furnace (8), the pyrolysis gas outlet of the pyrolysis separator (7) is connected with an inlet of the cleaner (14), the pyrolyzed coal ash outlet of the pyrolysis separator (7) is connected with the external bed (15) and further connected with the return feeder (13) through the external bed (15), and the return feeder (13) is connected with the fluidized bed combustion furnace (4).

3. The external bed type double-fluidized bed system for preventing boiler contamination according to claim 1, wherein the smoke outlet of the cyclone separator (5) is connected with a chimney through a draught fan (11).

4. The external bed type double-fluidized bed system for preventing boiler contamination according to claim 3, wherein the coal ash outlet of the fluidized bed pyrolysis furnace (8) is connected with the external bed (15), the external bed (15) is connected with the coal ash inlet on a side wall of the fluidized bed combustion furnace (4) through the same return feeder (13).

5. The external bed type double-fluidized bed system for preventing boiler contamination according to claim 4, wherein the fluidized bed combustion furnace (4) is connected with a first feeder (2) which is provided with a first coal hopper (1).

6. The external bed type double-fluidized bed system for preventing boiler contamination according to claim 4, wherein an outlet of a cleaner (14) is connected with a pyrolysis gas inlet on a side wall of the fluidized bed combustion furnace (4).

7. The external bed type double-fluidized bed system for preventing boiler contamination according to claim 6, wherein the raw coal inlet of the fluidized bed pyrolysis furnace (8) is connected with a second feeder (10) which is provided with a second coal hopper (9).

8. The external bed type double-fluidized bed system for preventing boiler contamination according to claim 7, wherein the working process of the system is as follows: a pyrolyzed semi-coke is combusted with air in the chamber of the fluidized bed combustion furnace (4), the resulting coal ash and smoke enters the cyclone separator (5) to be separated, one part of the separated smoke is fed into the fluidized bed pyrolysis furnace (8) through the second blower (12) while the other part is discharged from the chimney through the draught fan (11); the separated coal ash enters the coal ash distributor (6) to be divided into two parts according to the need of the fluidized bed pyrolysis furnace (8): one part is directly returned to the chamber of the fluidized bed combustion furnace (4) by the return feeder (13) through the first coal ash outlet while the other part enters the fluidized bed pyrolysis furnace (8) through the second coal ash outlet to be mixed with the high-alkalinity coals from the second coal hopper (9) and the second feeder (10) and then pyrolyzed in the fluidized bed pyrolysis furnace (8), the sodium contained in the gas resulting from the pyrolysis is removed using the cleaner (14), then the gas enters the fluidized bed combustion furnace (4) to be combusted; the pyrolyzed hot ash and high-alkalinity semi-coke enters the external bed (15) to be exchanged heat, after the temperature of the hot ash and the high-alkalinity semi-coke is adjusted, the hot ash and the high-alkalinity semi-coke enter the return feeder (13) through the external bed (15) and is then fed into the fluidized bed combustion furnace (4) by smoke to be combusted herein; the slag discharging of the boiler is carried out on the bottom of the fluidized bed combustion furnace (4); most of volatilizable sodium is removed after the high-alkalinity coals are pyrolyzed in the fluidized bed pyrolysis furnace (8), as the sodium content of the high-alkalinity coals is reduced, there is almost no contamination.

9. The external bed type double-fluidized bed system for preventing boiler contamination according to claim 2, wherein the smoke outlet of the cyclone separator (5) is connected with a chimney through a draught fan (11).

10. The external bed type double-fluidized bed system for preventing boiler contamination according to claim 9, wherein the coal ash outlet of the fluidized bed pyrolysis furnace (8) is connected with the external bed (15), the external bed (15) is connected with the coal ash inlet on a side wall of the fluidized bed combustion furnace (4) through the same return feeder (13).

11. The external bed type double-fluidized bed system for preventing boiler contamination according to claim 10, wherein the fluidized bed combustion furnace (4) is connected with a first feeder (2) which is vided with a first coal hopper (1).

12. The external bed type double-fluidized bed system for preventing boiler contamination according to claim 10, wherein an outlet of the cleaner (14) is connected with a pyrolysis gas inlet on a side wall of the fluidized bed combustion furnace (4).

13. The external bed type double-fluidized bed system for preventing boiler contamination according to claim 12, wherein the raw coal inlet of the fluidized bed pyrolysis furnace (8) is connected with a second feeder (10) which is provided with a second coal hopper (9).

14. The external bed type double-fluidized bed system for preventing boiler contamination according to claim 7, wherein the working process of the system is as follows: a pyrolyzed semi-coke is combusted with air in the chamber of the fluidized bed combustion furnace (4), the resulting coal ash and smoke enters the cyclone separator (5) to be separated, one part of the separated smoke is fed into the fluidized bed pyrolysis furnace (8) through the second blower (12) while the other part is discharged from the chimney through the draught fan (11); the separated coal ash enters the coal ash distributor (6) to be divided into two parts according to the need of the fluidized bed pyrolysis furnace (8): one part is directly returned to the chamber of the fluidized bed combustion furnace (4) by the return feeder (13) through the first coal ash outlet while the other part enters the fluidized bed pyrolysis furnace (8) through the second coal ash outlet to be mixed with the high-alkalinity coals from the second coal hopper (9) and the second feeder (10) and then pyrolyzed in the fluidized bed pyrolysis furnace (8), the sodium contained in the gas resulting from the pyrolysis is removed using the cleaner (14), then the gas enters the fluidized bed combustion furnace (4) to be combusted; the pyrolyzed hot ash and high-alkalinity semi-coke enters the external bed (15) to be exchanged heat, after the temperature of the hot ash and the high-alkalinity semi-coke is adjusted, the hot ash and the high-alkalinity semi-coke enter the return feeder (13) through the external bed (15) and is then fed into the fluidized bed combustion furnace (4) by smoke to be combusted herein; the slag discharging of the boiler is carried out on the bottom of the fluidized bed combustion furnace (4); most of volatilizable sodium is removed after the high-alkalinity coals are pyrolyzed in the fluidized bed pyrolysis furnace (8), as the sodium content of the high-alkalinity coals is reduced, there is almost no contamination.

15. The external bed type double-fluidized bed system for preventing boiler contamination according to claim 2, wherein an outlet of the cleaner (14) is connected with a pyrolysis gas inlet on a side wall of the fluidized bed combustion furnace (4).

16. The external bed type double-fluidized bed system for preventing boiler contamination according to claim 15, wherein the raw coal inlet of the fluidized bed pyrolysis furnace (8) is connected with a second feeder (10) which is provided with a second coal hopper (9).

17. The external bed type double-fluidized bed system for preventing boiler contamination according to claim 16, wherein the working process of the system is as follows: a pyrolyzed semi-coke is combusted with air in the chamber of the fluidized bed combustion furnace (4), the resulting coal ash and smoke enters the cyclone separator (5) to be separated, one part of the separated smoke is fed into the fluidized bed pyrolysis furnace (8) through the second blower (12) while the other part is discharged from the chimney through the draught fan (11); the separated coal ash enters the coal ash distributor (6) to be divided into two parts according to the need of the fluidized bed pyrolysis furnace (8): one part is directly returned to the chamber of the fluidized bed combustion furnace (4) by the return feeder (13) through the first coal ash outlet while the other part enters the fluidized bed pyrolysis furnace (8) through the second coal ash outlet to be mixed with the high-alkalinity coals from the second coal hopper (9) and the second feeder (10) and then pyrolyzed in the fluidized bed pyrolysis furnace (8), the sodium contained in the gas resulting from the pyrolysis is removed using the cleaner (14), then the gas enters the fluidized bed combustion furnace (4) to be combusted; the pyrolyzed hot ash and high-alkalinity semi-coke enters the external bed (15) to be exchanged heat, after the temperature of the hot ash and the high-alkalinity semi-coke is adjusted, the hot ash and the high-alkalinity semi-coke enter the return feeder (13) through the external bed (15) and is then fed into the fluidized bed combustion furnace (4) by smoke to be combusted herein; the slag discharging of the boiler is carried out on the bottom of the fluidized bed combustion furnace (4); most of volatilizable sodium is removed after the high-alkalinity coals are pyrolyzed in the fluidized bed pyrolysis furnace (8), as the sodium content of the high-alkalinity coals is reduced, there is almost no contamination.

* * * * *